US008701245B2

(12) United States Patent
Charlton et al.

(10) Patent No.: US 8,701,245 B2
(45) Date of Patent: Apr. 22, 2014

(54) HEIGHT ADJUSTMENT MECHANISM FOR A VACUUM CLEANER

(75) Inventors: Christopher M. Charlton, Medina, OH (US); Steven A. Frackowiak, Concord, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 592 days.

(21) Appl. No.: 12/856,332

(22) Filed: Aug. 13, 2010

(65) Prior Publication Data

US 2011/0035899 A1 Feb. 17, 2011

Related U.S. Application Data

(60) Provisional application No. 61/233,995, filed on Aug. 14, 2009.

(51) Int. Cl.
*A47L 5/34* (2006.01)

(52) U.S. Cl.
USPC ..... 15/354

(58) Field of Classification Search
USPC ..... 15/354, 356, 347, 368, 370, 355, 340.2
IPC ..... A47L 5/34,5/00, 9/04, 9/06
See application file for complete search history.

(56) References Cited

U.S. PATENT DOCUMENTS

| | | | | |
|---|---|---|---|---|
| 3,822,436 | A * | 7/1974 | Burgoon | 15/354 |
| 4,083,079 | A * | 4/1978 | Vermillion | 15/354 |
| 4,193,166 | A * | 3/1980 | Neff | 16/441 |
| 4,446,594 | A * | 5/1984 | Watanabe et al. | 15/323 |
| 4,467,495 | A * | 8/1984 | Fish et al. | 15/354 |
| 4,513,472 | A * | 4/1985 | Wells | 15/354 |
| 5,042,109 | A * | 8/1991 | Stephens | 15/354 |
| 5,222,276 | A * | 6/1993 | Glenn, III | 15/333 |
| 5,509,174 | A * | 4/1996 | Worrell | 16/441 |
| 5,551,120 | A * | 9/1996 | Cipolla et al. | 15/333 |
| 5,553,349 | A * | 9/1996 | Kilstrom et al. | 15/360 |

(Continued)

FOREIGN PATENT DOCUMENTS

JP 62207419 9/1987

OTHER PUBLICATIONS

Bissell Vacuum 3760 Users Manual 2005.*
Bissell Vacuum 3540 Users Manual 1998.*

(Continued)

*Primary Examiner* — Joseph J Hail
*Assistant Examiner* — Marc Carlson
(74) *Attorney, Agent, or Firm* — Michael Best & Friedrich LLP

(57) ABSTRACT

A vacuum cleaner including a handle and a base. The base includes a housing, a nozzle defining an inlet of the vacuum cleaner, and a lift assembly including a guide member configured to support the base on a surface. The vacuum further includes a height adjustment mechanism including a knob and a ramp. The knob is operable to rotate the ramp with respect to the housing, and the lift assembly is coupled to the ramp such that the lift assembly moves along the ramp to move the inlet from the lower position to the upper position in response to rotation of the ramp by the knob. The ramp includes a first end that defines a lower position of the inlet and a second end that defines an upper position of the inlet, and the ramp has a continuous incline from the first end to the second end.

29 Claims, 8 Drawing Sheets

(56) References Cited

U.S. PATENT DOCUMENTS

| | | | | |
|---|---|---|---|---|
| 5,613,275 | A * | 3/1997 | Kolberg et al. | 16/441 |
| 5,623,854 | A * | 4/1997 | Snider | 74/553 |
| 5,819,352 | A * | 10/1998 | Bancroft et al. | 15/52.1 |
| 5,906,024 | A * | 5/1999 | Jailor et al. | 15/354 |
| 6,076,230 | A * | 6/2000 | Harsh | 15/354 |
| 6,081,963 | A * | 7/2000 | Jailor et al. | 15/368 |
| 6,242,064 | B1 * | 6/2001 | Howie, Jr. | 428/35.7 |
| 6,357,076 | B1 * | 3/2002 | Lee | 15/354 |
| 7,111,365 | B1 * | 9/2006 | Howie, Jr. | 16/441 |
| 7,213,298 | B2 | 5/2007 | Cipolla et al. | |
| 7,222,390 | B2 | 5/2007 | Cipolla et al. | |
| 7,246,407 | B2 | 7/2007 | Park et al. | |
| 7,353,563 | B2 * | 4/2008 | Blocker et al. | 15/356 |
| 7,963,003 | B1 * | 6/2011 | Keene | 16/441 |
| 8,079,287 | B2 * | 12/2011 | Castillo | 74/553 |
| 2004/0134019 | A1 * | 7/2004 | Cipolla et al. | 15/340.2 |
| 2004/0211027 | A1 * | 10/2004 | Park et al. | 15/354 |
| 2005/0210625 | A1 * | 9/2005 | Joung et al. | 15/390 |
| 2007/0209147 | A1 * | 9/2007 | Krebs et al. | 15/347 |
| 2007/0220701 | A1 * | 9/2007 | Kwon et al. | 15/362 |
| 2007/0234505 | A1 * | 10/2007 | Gordon et al. | 15/354 |
| 2009/0056069 | A1 * | 3/2009 | Miner et al. | 15/415.1 |
| 2011/0035899 | A1 * | 2/2011 | Charlton et al. | 15/347 |
| 2012/0131764 | A1 * | 5/2012 | Miner et al. | 15/354 |
| 2013/0098742 | A1 * | 4/2013 | Bowen et al. | 200/336 |

OTHER PUBLICATIONS

Bissell Vacuum 3590 Users Manual 2004.*
Bissell Vacuum 3590C Users Manual 2002.*
Bissell Vacuum 3593 Users Manual 2004.*
PCT/US2010/045494 Search Report and Written Opinion, dated Oct. 26, 2010, (14 pages).
GB1202321.4 Examination Report dated Sep. 20, 2013 (3 pages).
Chinese Office Action for Chinese Application No. 201080043335.1 dated Dec. 25, 2014 (15 pages).

* cited by examiner

HEIGHT ADJUSTMENT MECHANISM FOR A VACUUM CLEANER

CROSS-REFERENCE TO RELATED APPLICATIONS

This application claims priority to U.S. Provisional Patent Application No. 61/233,995, filed Aug. 14, 2009, the entire contents of which are hereby incorporated by reference herein.

BACKGROUND

The present invention relates to vacuum cleaners, and more particularly to height adjustment mechanisms for vacuum cleaners.

Vacuum cleaners typically include a base or foot and a handle that pivots with respect to the base between an upright or storage position and an inclined position to allow the user to move the base of the vacuum along a surface to be cleaned. The base of the vacuum often includes an inlet through which a mixture of air and debris from the surface travels into the vacuum. In many vacuums a brush roll or agitator is located near the inlet. The agitator is typically rotated by a motor of the vacuum to agitate the surface to facilitate the removal of dust and debris from the surface. Often, the user may desire to vary the distance between the surface and the inlet and the agitator. For example, depending on the type of surface, such as the type of carpet or carpet pile, the user may desire the inlet and agitator to be closer or farther from the surface. Accordingly, many vacuums include a height adjustment mechanism that allows the user change the distance between the inlet and agitator and the surface.

SUMMARY

In one embodiment, the invention provides a vacuum cleaner configured to remove debris from a surface. The vacuum cleaner includes a suction source, a dirt collection chamber in fluid communication with the suction source, a handle coupled to the suction source and the dirt collection chamber, and a base coupled to the handle and configured to be moved along the surface by the handle. The base includes a housing, a nozzle defining an inlet of the vacuum cleaner through which debris travels from the surface toward the dirt collection chamber, and a lift assembly including a guide member configured to support the base on the surface. The lift assembly is coupled to the housing for movement with respect to the housing to move the inlet from a lower position in which the inlet is a first distance above the surface to an upper position in which the inlet is a second distance above the surface. The first distance is less than the second distance. The vacuum further includes a height adjustment mechanism including a knob and a ramp. The knob is operable to rotate the ramp with respect to the housing, and the lift assembly is coupled to the ramp such that the lift assembly moves along the ramp to move the inlet from the lower position to the upper position in response to rotation of the ramp by the knob. The ramp includes a first end that defines the lower position and a second end that defines the upper position, and the ramp has a continuous incline from the first end to the second end.

In another embodiment the invention provides a vacuum cleaner configured to remove debris from a surface. The vacuum cleaner includes a suction source, a dirt collection chamber in fluid communication with the suction source, a handle coupled to the suction source and the dirt collection chamber, and a base coupled to the handle and configured to be moved along the surface by the handle. The base includes a housing, a nozzle defining an inlet of the vacuum cleaner through which debris travels from the surface toward the dirt collection chamber, and a lift assembly including a guide member configured to support the base on the surface. The lift assembly is coupled to the housing for movement with respect to the housing to move the inlet from a lower position in which the inlet is a first distance above the surface to an upper position in which the inlet is a second distance above the surface. The first distance is less than the second distance. The vacuum further includes a height adjustment mechanism including a ramp and a knob rotatable with respect to the housing about an axis to rotate the ramp with respect to the housing. The knob is movable along the axis with respect to the housing and the ramp between a locked position and an unlocked position. The height adjustment mechanism further includes a biasing member that biases the knob toward the locked position. The knob is manually rotatable about the axis with respect to the housing when the knob is in the unlocked position to rotate the ramp with respect to the housing. The lift assembly is coupled to the ramp such that the lift assembly moves along the ramp to move the lift assembly with respect to the housing and to move the inlet from the lower position to the upper position in response to rotation of the ramp by the knob. The knob is fixed from rotation with respect to the housing about the axis when the knob is in the locked position to fix the position of the ramp and retain the inlet in the upper position and the lower position.

In another embodiment the invention provides a vacuum cleaner configured to remove debris from a surface. The vacuum cleaner includes a handle, a suction source disposed within the handle, a dirt collection chamber removable coupled to the handle and in fluid communication with the suction source, and a base pivotally coupled to the handle and configured to be moved along the surface by the handle. The base includes a housing, a nozzle defining an inlet of the vacuum cleaner through which debris travels from the surface toward the dirt collection chamber, and a lift assembly including a guide member configured to support the base on the surface. The lift assembly is coupled to the housing for movement with respect to the housing to move the inlet from a lower position in which the inlet is a first distance above the surface to an upper position in which the inlet is a second distance above the surface. The first distance is less than the second distance. The vacuum further includes a height adjustment mechanism including a ramp having a first end that defines the lower position, a second end that defines the upper position, and a continuous incline from the first end to the second end. The height adjustment mechanism further includes a knob rotatable with respect to the housing about an axis to rotate the ramp with respect to the housing. The knob is movable along the axis with respect to the housing and the ramp between a locked position and an unlocked position. A biasing member biases the knob toward the locked position. The knob is manually rotatable about the axis with respect to the housing when the knob is in the unlocked position to rotate the ramp with respect to the housing. The lift assembly is coupled to the ramp such that the lift assembly moves along the ramp to move the inlet from the lower position to the upper position in response to rotation of the ramp by the knob. The knob is fixed from rotation with respect to the housing about the axis when the knob is in the locked position to fix the position of the ramp and retain the inlet in the upper position and the lower position.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
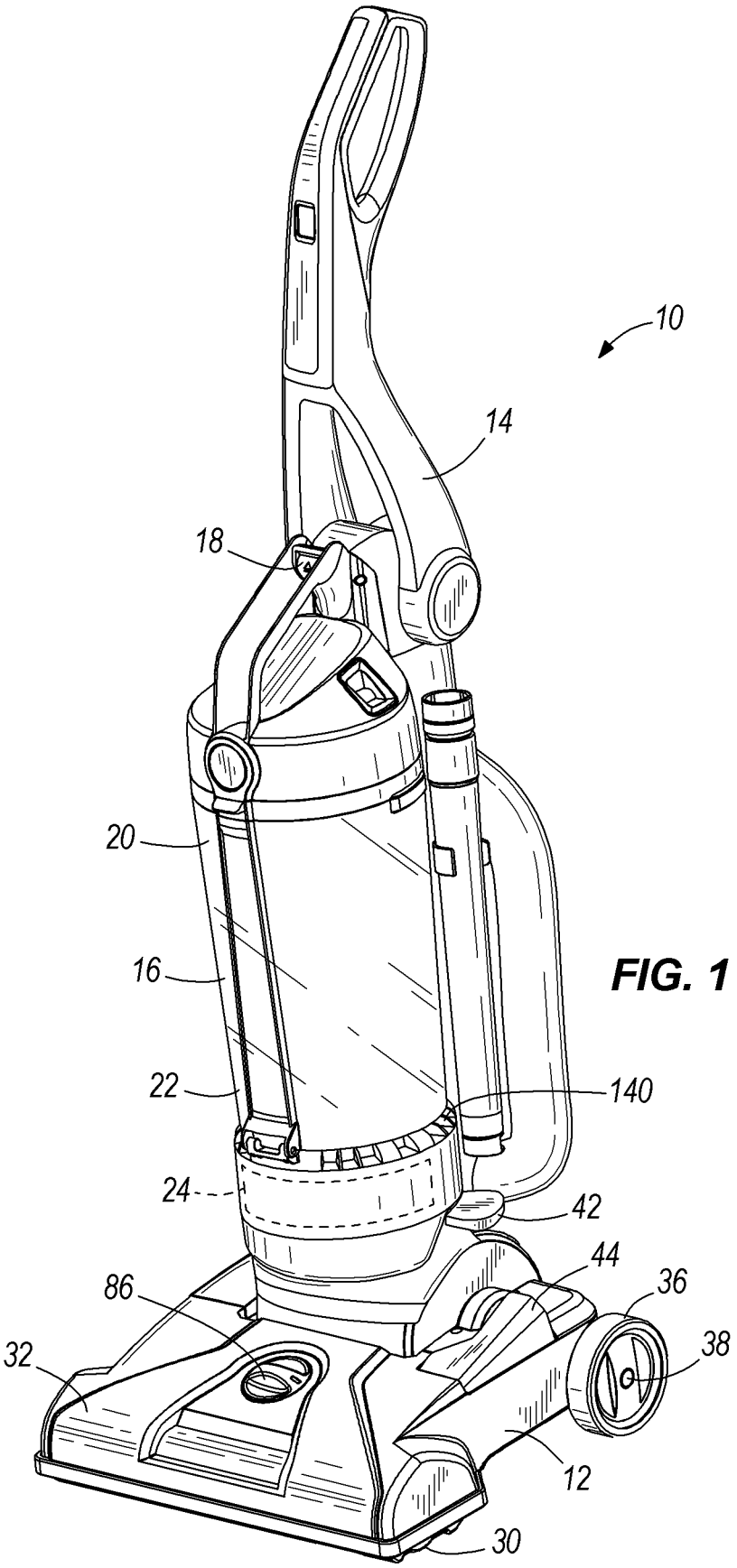
FIG. 1 is a perspective view of a vacuum according to one embodiment of the invention.

FIG. 1 illustrates a vacuum cleaner 10. The illustrated vacuum 10 includes a foot or base 12 and a handle 14 that is pivotally coupled to the base 12 such that in the illustrated embodiment, the vacuum cleaner 10 is an upright vacuum cleaner. The vacuum 10 further include a canister 16 that is removably coupled to the handle 14 via a latch 18. In the illustrated embodiment, the canister 16 forms a portion of a cyclonic separator 20 and a dirt collection chamber 22 located below the separator 20 to collect dirt and debris separated by the separator 20. While the illustrated separator 20 and dirt collection chamber 22 are formed as a portion of the canister 16, in other embodiments, the separator and dirt collection chamber can include vacuum bags, filters, and the like. A suction source 24 is disposed within the handle 14 and is operable to generate an airflow through the canister 16.

Figure 2:
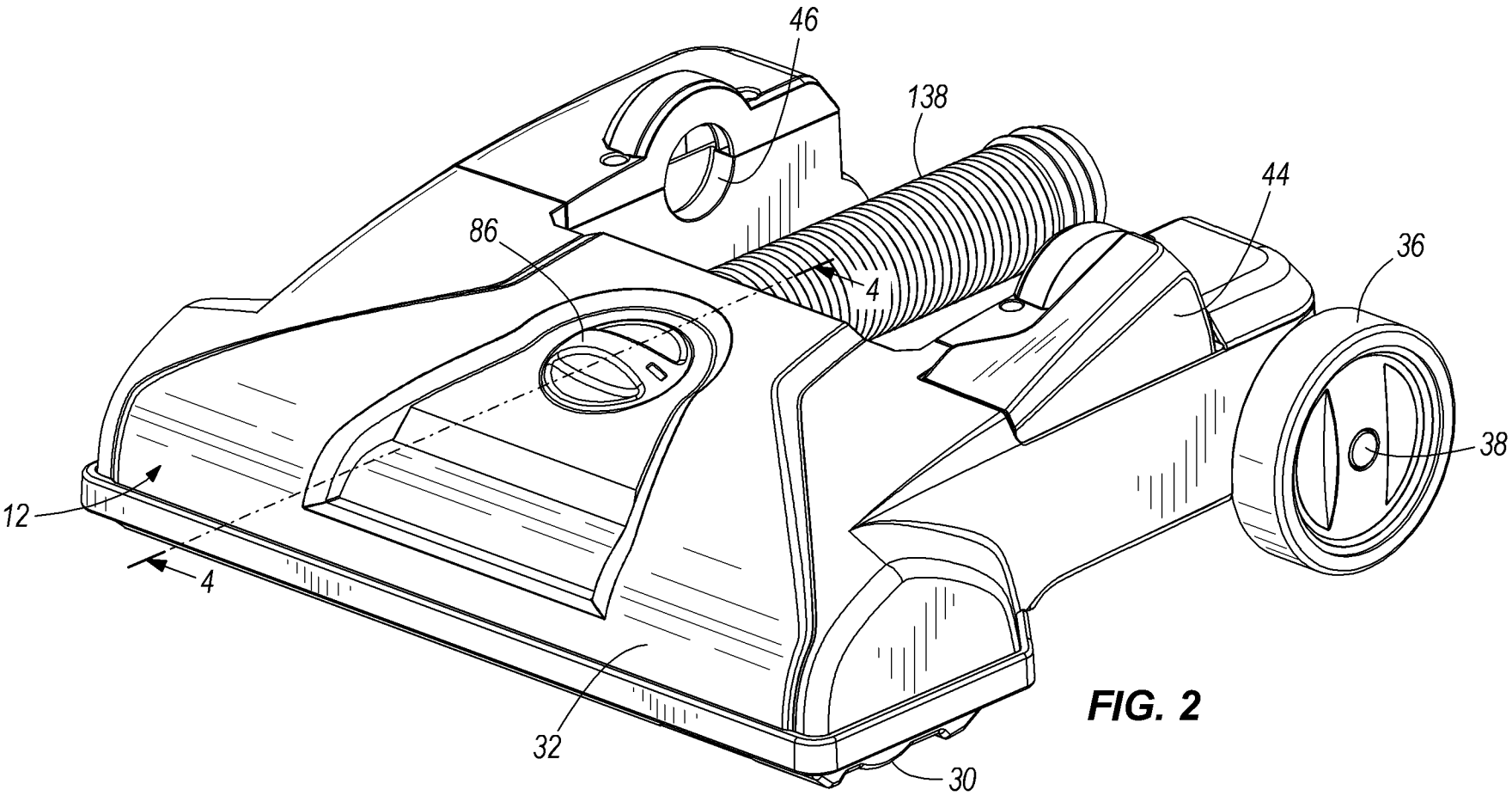
FIG. 2 is a perspective view of a base of the vacuum of FIG. 1.
Figure 3:
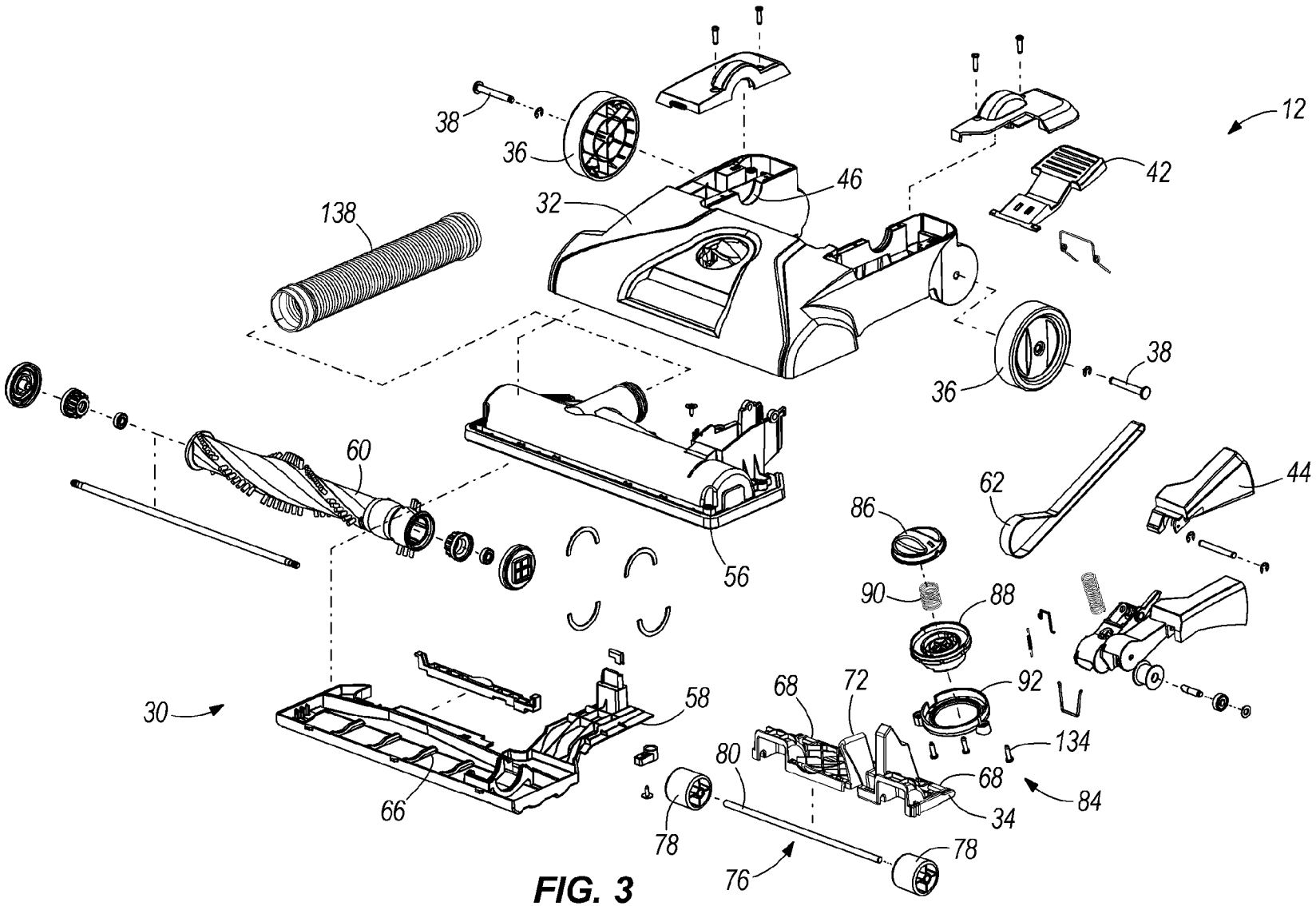
FIG. 3 is an exploded view of the base of FIG. 2.

Referring to FIGS. 2 and 3, the base 12 includes a nozzle 30, housing 32, and a lift assembly 34. The housing 32 forms a cover over the nozzle 30 and provides an attachment point for additional components of the base 12 and the vacuum 10. Guide members 36, which are wheels in the illustrated embodiment, are rotatably coupled to the housing 32 via pins 38. The guide members 36 support the base 12 on a surface 40 (FIG. 4) that is cleaned by the vacuum 10. A handle pedal release 42 and a brush roll shutoff assembly 44 are also coupled to the housing 32. Referring to FIGS. 1 and 2, the handle 14 is pivotally coupled to the base 12 via apertures 46 in the housing 32 and the handle pedal release 42 allows a user to lock the handle 14 in the upright position (FIG. 1).

Figure 4:
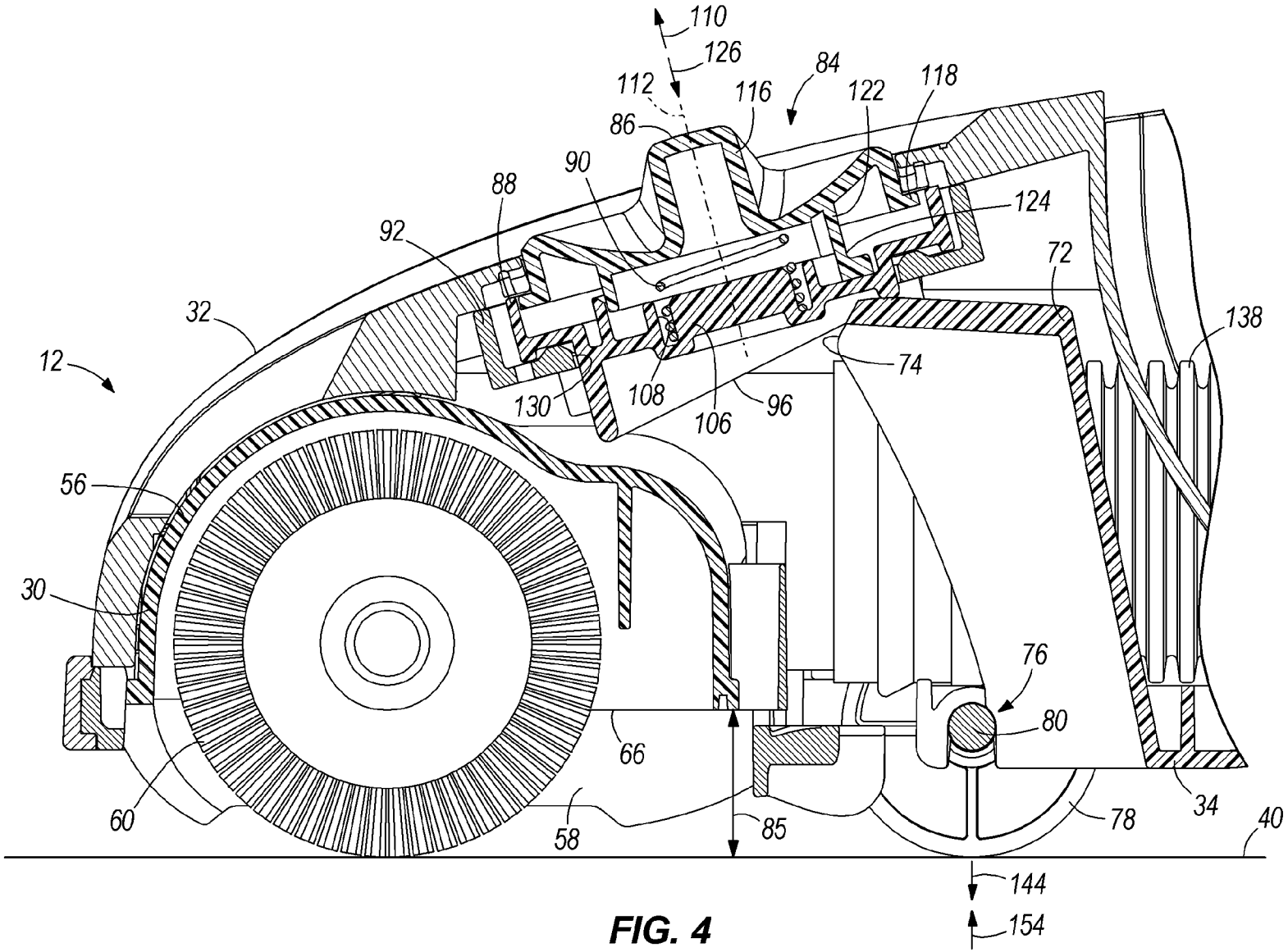
FIG. 4 is a cross-sectional view of the base of FIG. 2 taken along line 4-4 of FIG. 2.

Referring to FIG. 3, the nozzle 30 includes an upper housing portion 56 and a lower housing portion 58. An agitator brush or brush roll 60 is rotatably mounted in the housing portions 56 and 58 and can be driven by a belt 62. Tension in the belt 62 is adjusted via the brush roll shutoff 44 to regulate whether the brush roll 60 is driven by the belt 62. As best seen in FIGS. 3 and 4, the lower housing portion 58 defines an inlet 66 of the vacuum 10.

Figure 6:
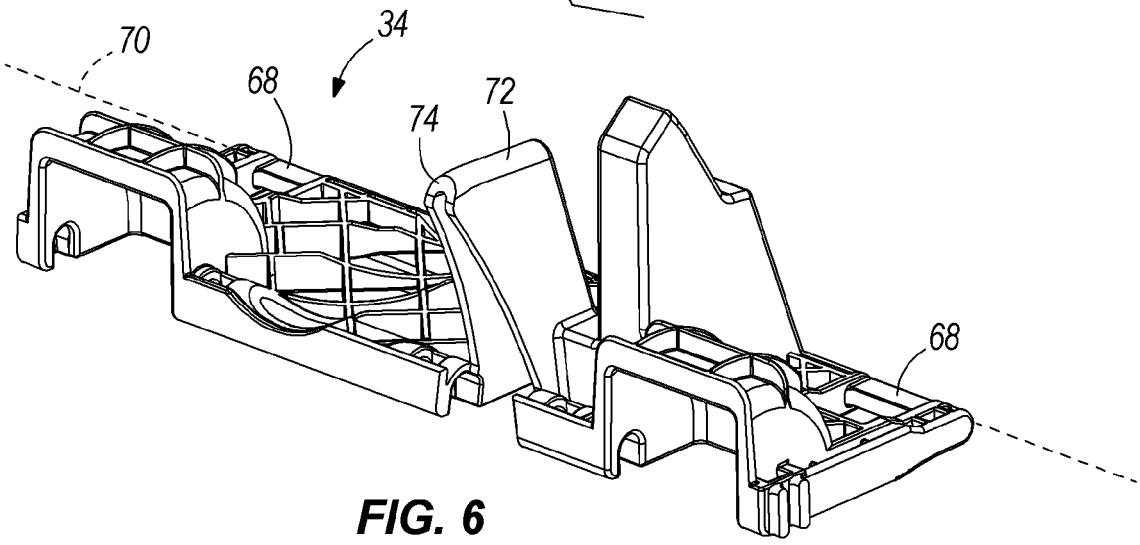
FIG. 6 is a perspective view of a portion of a lift assembly of the vacuum of FIG. 1.

Referring to FIGS. 3, 4, and 6, the lift assembly 34 is pivotally coupled to the housing 32 of the base 12 via connecting portions 68 such that the lift assembly 34 pivots with respect to the housing 32 about an axis 70. As will be discussed in more detail below, the lift assembly 34 pivots about the axis 70 to adjust the height of the nozzle inlet 66 with respect to the surface 40. The lift assembly 34 further includes a projection 72 that includes a cam surface 74. A guide member 76, which includes wheels 78 rotatably mounted on an axle 80, is coupled to the lift assembly 34 to support the lift assembly 34 and the base 12 on the surface 40.

Figure 5:
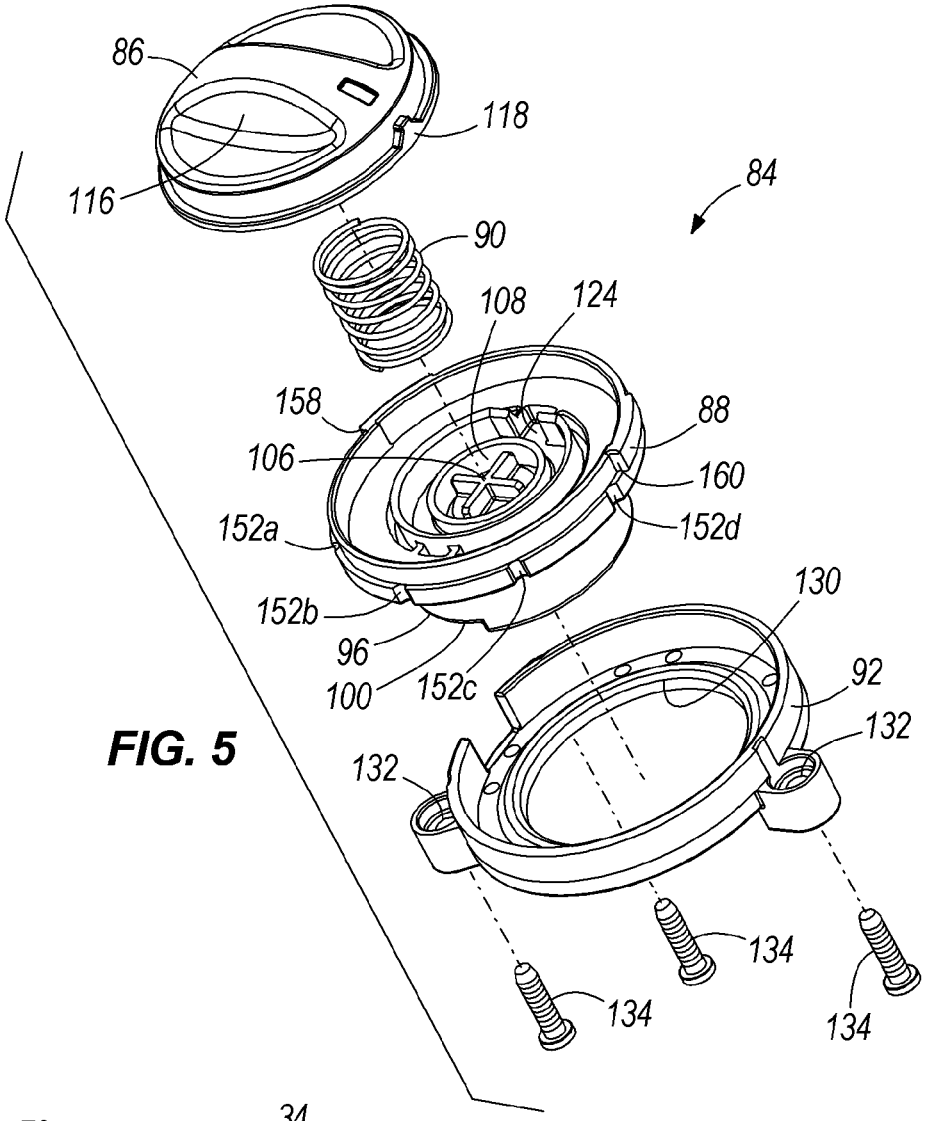
FIG. 5 is an exploded view of a height adjustment mechanism of the vacuum of FIG. 1.

Referring to FIGS. 4 and 5, the vacuum 10 further includes a height adjustment mechanism 84. As will be discussed in more detail below, the height adjustment mechanism 84 is operable by the user to adjust a distance 85 (FIG. 4) of the inlet 66 above the surface 40. The height adjustment mechanism 84 includes a knob 86, a ramp member 88, a biasing member 90 between the knob 86 and the ramp member 88, and a bracket 92 that couples the knob 86, the ramp member 88, and the biasing member 90 to the housing 32.

Figure 9:
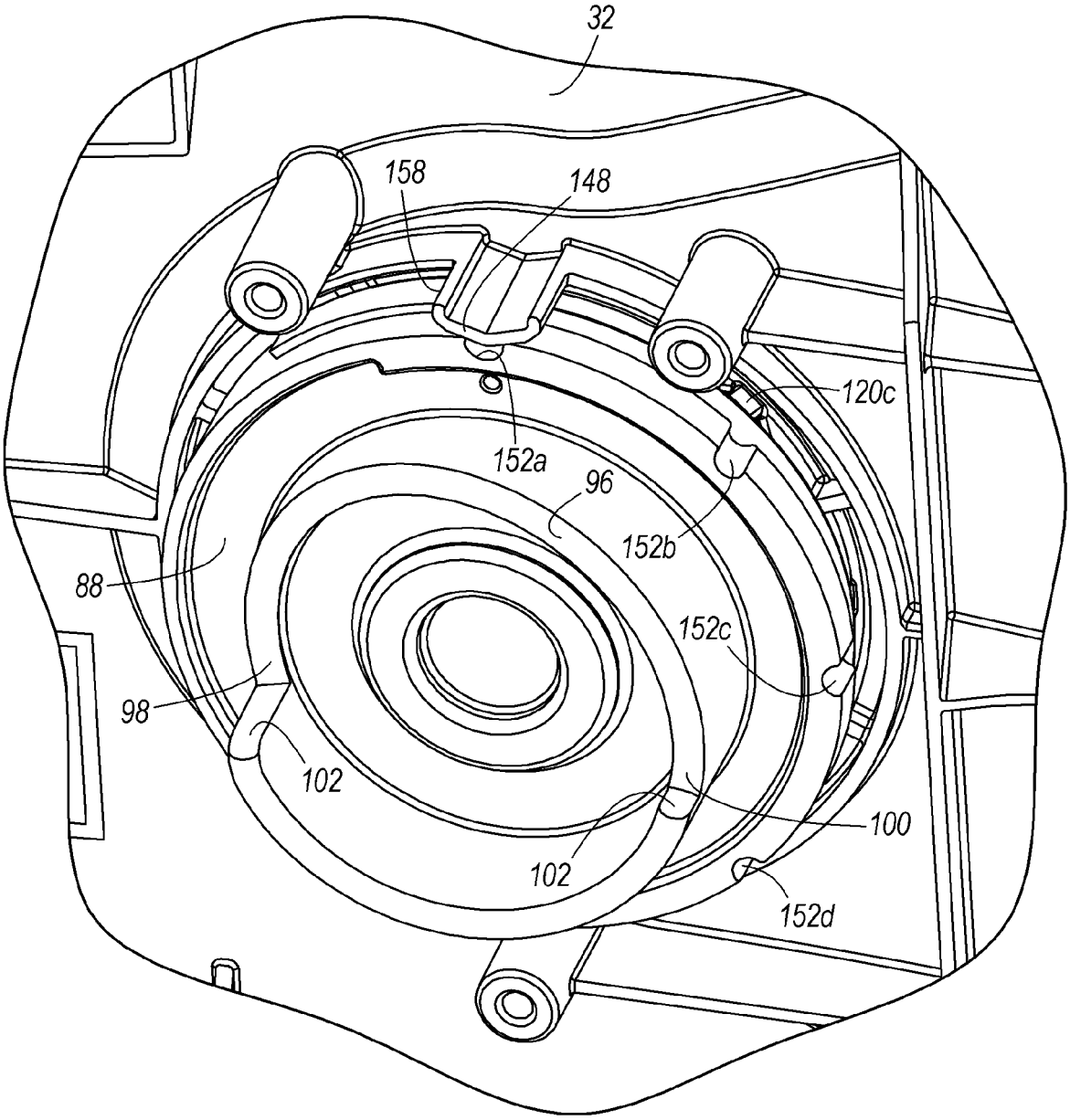
FIG. 9 is a perspective view of an underside of a housing of the base of FIG. 2 with portions of the base removed.

Referring to FIGS. 5 and 9, the ramp member 88 is somewhat cylindrically shaped and includes a ramp 96 formed on an underside of the ramp member 88. The ramp 96 includes a first end 98 and a second end 100. The ramp 96 has a continuous or interrupted incline from the first end 98 to the second end 100 as best illustrated in FIG. 9. Also, in the illustrated embodiment, the ramp 96 has a constant incline. As illustrated in FIG. 4, the cam surface 74 of the lift assembly 34 is coupled to the ramp 96 such that the cam surface 74 slides along the ramp 96 from the first end 98 to the second end 100. In the illustrated embodiment, the ramp member 88 includes stops 102 (FIG. 9) adjacent each of the ends 98 and 100 that inhibit movement of the cam surface 74 past the ends 98 and 100. However, in other embodiments, the ramp may not include such stops and as used herein the end of the ramp should be understood to mean the end of travel of the cam surface along the ramp regardless of whether the ramp includes a physical stop to inhibit further movement of the cam surface along the ramp.

Referring to FIGS. 4 and 5, the ramp member 88 further includes a boss 106 and a recess 108 on a top side of the ramp member 88. The boss 106 extends into the biasing member 90, which is a coil spring in the illustrated embodiment, to provide support for the biasing member 90, and the biasing member 90 extends into the recess 108. The biasing member 90 biases the knob 86 in the direction of arrow 110 of FIG. 4 along an axis 112 about which the knob 86 and the ramp member 88 rotate with respect to the housing 32.

Figure 7:
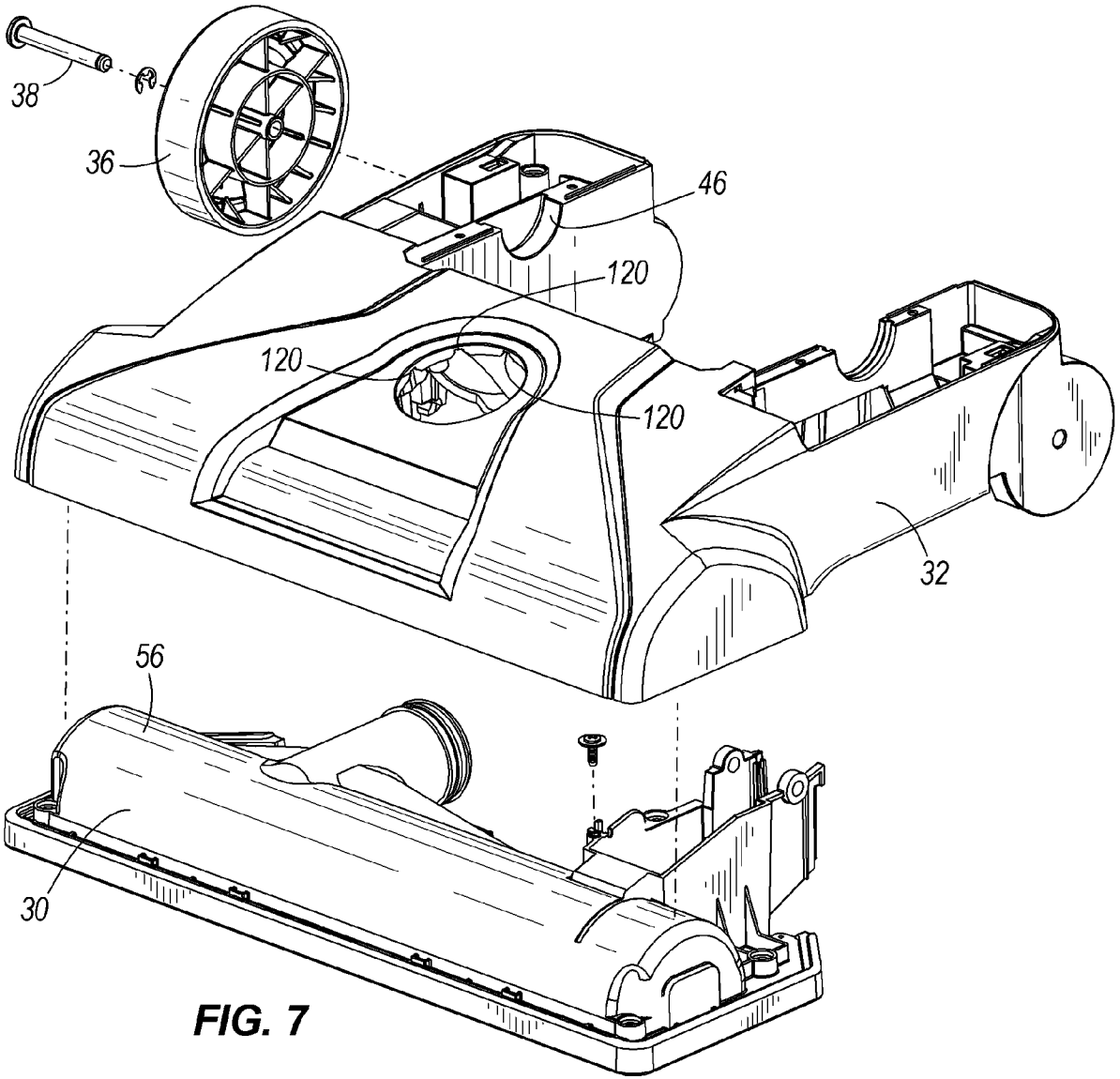
FIG. 7 is a partially exploded view of a portion of the base of FIG. 2.
Figure 8:
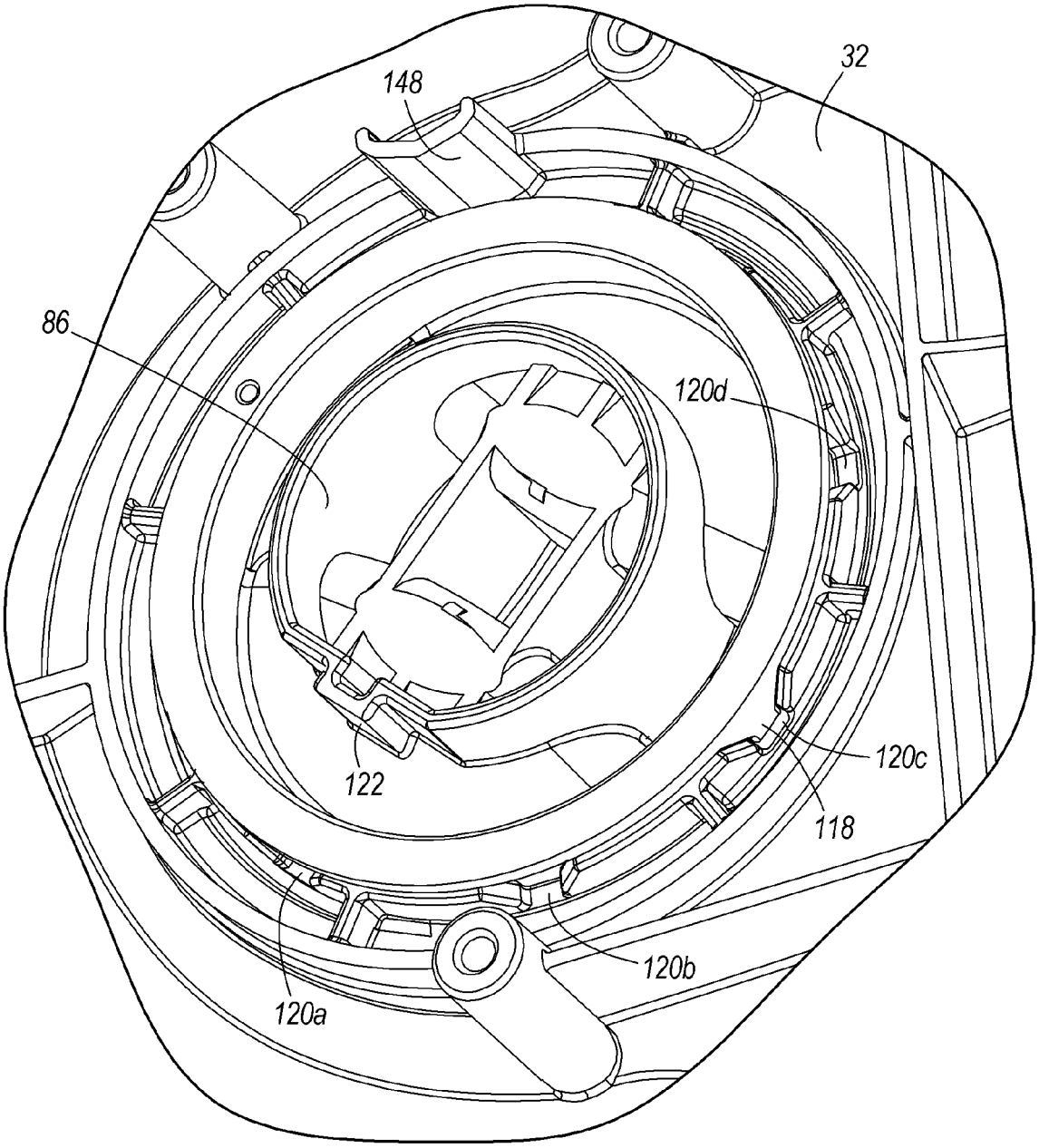
FIG. 8 is a perspective view of an underside of a housing of the base of FIG. 2 with portions of the base removed.

The knob 86 includes a thumb turn actuator 116 that the user grabs to rotate the knob 86 with respect to the housing 32 about the axis 112. The knob 86 further includes a first projection 118 formed at an outer periphery of the knob 86. As will be discussed in more detail below, the projection 118 can be received in recesses **120*a*-120*c* on an underside of the housing 32 (FIGS. 7 and 8). The knob 86 further includes a second projection 122 on an underside of the knob 86 (FIG. 8). The projection 122 is received in a recess 124 (FIG. 5) of the ramp member 88 to couple the ramp member 88 and the knob 86 for co-rotation with respect to the housing 32 about the axis 122. However, the projection 122 and recess 124 are sized such that the knob 86 can move along the axis 112 in the directions of arrows 110 and 126 (FIG. 4) along the axis 112 with respect to the ramp member 88 and the housing 32**.

As best seen in FIGS. 4 and 5, the bracket 92 includes a central aperture 130 and peripheral apertures 132 located around the central aperture 130. The ramp member 88 extends through the central aperture 130 and fasteners 134 extend through the peripheral apertures 132 to couple the ramp member 88, the knob 86, and the biasing member 90 to the underside of the housing 32.

In operation, the suction source 24 of the vacuum 10 (FIG. 1) generates an suction or airflow that travels into the vacuum 10 through the inlet 66 (FIG. 4) to remove dirt and debris from the surface 40. With continued reference to FIGS. 1 and 4, the air and debris travels through a conduit 138 and into the cyclonic separator 20 where the debris and air are separated. The debris generally falls into the dirt collection chamber 22 while relatively clean and filtered air is exhausted through an outlet or exhaust opening 140.

Referring to FIG. 4, depending on the application of the vacuum 10, including the type of surface 40, the user may desire to change the distance 85 that the inlet 66, and therefore the brush roll 60 in the illustrated embodiment, is positioned above the surface 40. The user adjusts the distance 85 using the height adjustment mechanism 84. For example, if the inlet 66 is positioned at a lower position (FIG. 4) the user can raise the inlet 66, and therefore the brush roll 60, to an upper position to increase the distance 85. In the lower position (FIG. 4), the cam surface 74 of the lift assembly 34 is at the first end 98 of the ramp 96 (FIG. 9). To raise the inlet 66, the user first presses the knob 86 in the direction of arrow 126 to move the knob 86 from a locked position where the projection 118 is received in one of the recesses 120*a*-120*d* (FIG. 8) to an unlocked position where the projection 118 is outside of one of the recesses 120*a*-120*d*.

With the knob 86 in the unlocked position, the user can rotate the knob 86 in a first direction about the axis 112 with respect to the housing 32. Rotating the knob 86 also rotates the ramp member 88, and therefore the ramp 96. Rotating the knob 86 in the first direction causes the cam surface 74 to move or slide along the ramp 96 from the first end 98 toward the second end 100 (FIG. 9). As the cam surface 74 moves along the ramp 96 from the first end 98 toward the second end 100, the lift assembly 34 is forced to pivot about the axis 70 (FIG. 6) with respect to the housing 32. This movement of the lift assembly 34 causes the wheels 78 to move generally in the direction of arrow 144 (FIG. 4) with respect to the housing 32 and wheels 36 (FIG. 2). Movement of the wheels 78 in the direction of arrow 144 raises the inlet 66 and increases the distance 85.

The user can continue to rotate the knob 86 until the cam surface 74 reaches the second end 100 of the ramp 96. When the cam surface 74 reaches the second end 100 of the ramp 96, a projection or tab 148 (FIG. 9) of the housing 32 is received in a detent 152*a* formed on the periphery of the ramp member 88 to provide the user with an audible indication or feeling that the upper position has been reached. Also, the ramp member 88 includes a first stop 158 that contacts the tab 148 when the upper position has been reached to inhibit the user from rotating the knob 86 and the ramp 96 past the upper position. Then, the user releases the knob 86 and the biasing member 90 moves the knob 86 back to the locked position. In the locked position, the projection 118 is received in one of the recesses 120*a*-120*d* to retain the knob 86 in the locked position and hold the knob 86 from rotation about the axis 112. With the knob 86 held in the locked position via the projection 118 and the recess 120*d*, the knob 86 holds the ramp member 88 from rotation about the axis 112. Therefore, the inlet 66 is retained in the upper position.

To move the inlet 66 back to the lower position, the steps above are repeated but the knob is rotated in a second direction about the axis 112 opposite the first direction that moves the inlet 66 from the lower position to the upper position. When the inlet 66 moves from the upper position toward the lower position, the lift assembly 34 moves in the direction of arrow 154 of FIG. 4 to decrease the distance 85. Also, the tab 148 (FIG. 9) is received in a corresponding detent 152*d* of the ramp member 88 to provide an indication to the user that the lower position has been reached. Also, the ramp member 88 includes a second stop member 160 (FIG. 5) that contacts the tab 148 when the lower position has been reached to inhibit the user from rotating the knob 86 and the ramp 96 past the lower position. The projection 118 of the knob 86 is also received in the recess 120*a* to retain the inlet 66 in the lowered position. In addition, the ramp member 88 includes intermediate detents 152*b* and 154*c* and the housing 32 includes intermediate recesses 120*b* and 120*c* so that the inlet 66 can be positioned between the upper and lower positions. While the illustrated height adjustment mechanism 84 includes two intermediate positions, in other embodiments the height adjustment mechanism can include more or fewer than two intermediate positions.

Accordingly, the distance 85 between the inlet 66 and the surface 40 can be adjusted easily by the user using the height adjustment mechanism 84. The user simply pushes the knob 86 and rotates the knob 86 then releases the knob 86 when the inlet 66 is in the desired position. Also, the ramp 96 is continuous such that the user can easily rotate the knob 86. A discontinuous ramp including cam surfaces or undulations makes it difficult for the user to adjust the height because the user must move past or through the cam surfaces or undulations in order to rotate the ramp and adjust the height of the inlet.

Various features and advantages of the invention are set forth in the following claims.

What is claimed is:

1. A vacuum cleaner configured to remove debris from a surface, the vacuum cleaner comprising:

a suction source;

a dirt collection chamber in fluid communication with the suction source;

a handle coupled to the suction source and the dirt collection chamber;

a base coupled to the handle and configured to be moved along the surface by the handle, the base including, a housing, a nozzle defining an inlet of the vacuum cleaner through which debris travels from the surface toward the dirt collection chamber, a lift assembly including a guide member configured to support the base on the surface, the lift assembly coupled to the housing for movement with respect to the housing to move the inlet from a lower position in which the inlet is a first distance above the surface to an upper position in which the inlet is a second distance above the surface, the first distance less than the second distance, and a height adjustment mechanism including a knob and a ramp member, the ramp member including a ramp, a first stop, and a second stop, the knob coupled to the ramp for co-rotation with respect to the housing and operable to rotate the ramp with respect to the housing, the first stop limiting rotation of the ramp and the knob with respect the housing in a first direction, the second stop limiting rotation of the ramp and the knob with respect to the housing in a second direction opposite the first direction, and the lift assembly coupled to the ramp such that the lift assembly moves along the ramp to move the inlet from the lower position to the upper position in response to rotation of the ramp by the knob, wherein the ramp includes a first end that defines the lower position and a second end that defines the upper position, wherein the ramp has a continuous incline from the first end to the second end, wherein the knob includes a projection, wherein the housing includes a first recess and a second recess, wherein the projection of the knob is received in the first recess when the inlet is in the lower position to fix the knob and the ramp from rotation with respect to the housing, and wherein the projection of the knob is received in the second recess when the inlet is in the upper position to fix the knob and the ramp from rotation with respect to the housing, and wherein the knob and the ramp are rotatable with respect to the housing about an axis, the knob being movable along the axis between a locked position and an unlocked position with respect to the housing and the ramp, wherein when the knob is in the locked position, the projection of the knob is received in one of the first and the second recesses, and when the knob is in the unlocked position the projection of the knob is outside of the first and the second recesses such that the knob and ramp are rotatable about the axis to move the inlet between the upper and the lower positions.

2. The vacuum cleaner of claim 1, wherein the ramp has a constant incline.

3. The vacuum cleaner of claim 1, wherein the lift assembly is pivotally coupled to the housing such that the lift assembly can pivot with respect to the housing.

4. The vacuum cleaner of claim 3, further comprising a first wheel coupled to the housing, and wherein the guide member includes a second wheel, wherein the lift assembly pivots with respect to the housing to move the second wheel with respect to the first wheel to move the inlet between the upper and the lower positions.

5. The vacuum cleaner of claim 3, wherein the lift assembly includes a cam surface, wherein the cam surface rides along the ramp to move the inlet between the upper and the lower positions.

6. The vacuum cleaner of claim 1, wherein the ramp member includes a recess, wherein a biasing member is received within the recess to bias the knob along the axis away from the ramp member.

7. The vacuum cleaner of claim 1, wherein the ramp member includes a first detent and a second detent, wherein the base includes a projection received in the first detent when the inlet is in the lower position and the projection is received in the second detent when the inlet is in the upper position.

8. A vacuum cleaner configured to remove debris from a surface, the vacuum cleaner comprising:

a suction source;

a dirt collection chamber in fluid communication with the suction source;

a handle coupled to the suction source and the dirt collection chamber;

a base coupled to the handle and configured to be moved along the surface by the handle, the base including, a housing, a nozzle defining an inlet of the vacuum cleaner through which debris travels from the surface toward the dirt collection chamber, a lift assembly including a guide member configured to support the base on the surface, the lift assembly coupled to the housing for movement with respect to the housing to move the inlet from a lower position in which the inlet is a first distance above the surface to an upper position in which the inlet is a second distance above the surface, the first distance less than the second distance, and a height adjustment mechanism including a ramp, a knob rotatable with respect to the housing about an axis to rotate the ramp with respect to the housing, the knob movable along the axis between a locked position and an unlocked position with respect to the housing and the ramp, and a biasing member that biases the knob toward the locked position, wherein the knob is manually rotatable about the axis with respect to the housing when the knob is in the unlocked position to rotate the ramp with respect to the housing, wherein the lift assembly is coupled to the ramp such that the lift assembly moves along the ramp to move the lift assembly with respect to the housing and to move the inlet from the lower position to the upper position in response to rotation of the ramp by the knob, and wherein the knob is fixed from rotation with respect to the housing about the axis when the knob is in the locked position to fix the position of the ramp and retain the inlet in the upper position and the lower position.

9. The vacuum cleaner of claim 8, wherein the knob is coupled to the ramp for co-rotation with respect to the housing.

10. The vacuum cleaner of claim 8, further comprising a ramp member, wherein the ramp is formed on the ramp member, wherein the ramp member includes a recess, wherein the biasing member is received within the recess to bias the knob along the axis away from the ramp member.

11. The vacuum cleaner of claim 8, further comprising a ramp member, wherein the ramp is formed on the ramp member, wherein the ramp member includes a first detent and a second detent, wherein the base includes a projection received in the first detent when the inlet is in the lower position and the projection is received in the second detent when the inlet is in the upper position.

12. The vacuum cleaner of claim 8, wherein the knob includes a projection, wherein the housing includes a first recess and a second recess, wherein the projection of the knob is received in the first recess when the inlet is in the lower position and the knob is in the locked position to fix the knob and the ramp from rotation with respect to the housing, and wherein the projection of the knob is received in the second recess when the inlet is in the upper position and the knob is in the locked position to fix the knob and the ramp from rotation with respect to the housing.

13. The vacuum cleaner of claim 12, wherein the knob is movable with respect to the housing and the ramp along the axis to move the knob from the locked position where the projection of the knob is received in one of the first and the second recesses and the unlocked position where the projection of the knob is outside of the recess such that the knob and ramp are rotatable about the axis to move the nozzle between the upper and the lower positions.

14. The vacuum cleaner of claim 8, wherein the ramp has a constant incline.

15. The vacuum cleaner of claim 8, wherein the lift assembly is pivotally coupled to the housing such that the lift assembly can pivot with respect to the housing to move the inlet between the upper and the lower positions.

16. The vacuum cleaner of claim 15, further comprising a first wheel coupled to the housing, and wherein the guide member includes a second wheel, wherein the lift assembly pivots with respect to the housing to move the second wheel with respect to the first wheel to move the inlet between the upper and the lower positions.

17. The vacuum cleaner of claim 15, wherein the lift assembly includes a cam surface, wherein the cam surface rides along the ramp to move the inlet between the upper and the lower positions.

18. The vacuum cleaner of claim 8, wherein the height adjustment mechanism further includes a ramp member, wherein the ramp is formed on the ramp member, the ramp member including a first stop and a second stop, the first stop limiting rotation of the ramp and the knob with respect the housing in a first direction, the second stop limiting rotation of the ramp and the knob with respect to the housing in a second direction opposite the first direction.

19. A vacuum cleaner configured to remove debris from a surface, the vacuum cleaner comprising:

a handle;

a suction source disposed within the handle;

a dirt collection chamber removable coupled to the handle and in fluid communication with the suction source;

a base pivotally coupled to the handle and configured to be moved along the surface by the handle, the base including, a housing, a nozzle defining an inlet of the vacuum cleaner through which debris travels from the surface toward the dirt collection chamber, a lift assembly including a guide member configured to support the base on the surface, the lift assembly coupled to the housing for movement with respect to the housing to move the inlet from a lower position in which the inlet is a first distance above the surface to an upper position in which the inlet is a second distance above the surface, the first distance less than the second distance, and a height adjustment mechanism including, a ramp having a first end that defines the lower position, a second end that defines the upper position, and a continuous incline from the first end to the second end, a knob rotatable with respect to the housing about an axis to rotate the ramp with respect to the housing, the knob movable along the axis between a locked position and an unlocked position with respect to the housing and the ramp, and a biasing member that biases the knob toward the locked position, wherein the knob is manually rotatable about the axis with respect to the housing when the knob is in the unlocked position to rotate the ramp with respect to the housing, wherein the lift assembly is coupled to the ramp such that the lift assembly moves along the ramp to move the inlet from the lower position to the upper position in response to rotation of the ramp by the knob, and wherein the knob is fixed from rotation with respect to the housing about the axis when the knob is in the locked position to fix the position of the ramp and retain the inlet in the upper position and the lower position.

20. The vacuum cleaner of claim 19, wherein the knob includes a projection, wherein the housing includes a first recess and a second recess, wherein the projection of the knob is received in the first recess when the inlet is in the lower position and the knob is in the locked position to fix the knob and the ramp from rotation with respect to the housing, and wherein the projection of the knob is received in the second recess when the inlet is in the upper position and the knob is in the locked position to fix the knob and the ramp from rotation with respect to the housing.

21. The vacuum cleaner of claim 20, wherein the knob is movable with respect to the housing and the ramp along the axis to move the knob from the locked position where the projection of the knob is received in one of the first and the second recesses and the unlocked position where the projection of the knob is outside of the recess such that the knob and ramp are rotatable about the axis to move the nozzle between the upper and the lower positions.

22. The vacuum cleaner of claim 19, wherein the knob is coupled to the ramp for co-rotation with respect to the housing.

23. The vacuum cleaner of claim 19, wherein the height adjustment mechanism further includes a ramp member, wherein the ramp is formed on the ramp member, wherein the ramp member includes a recess, wherein the biasing member is received within the recess to bias the knob along the axis away from the ramp member.

24. The vacuum cleaner of claim 19, wherein the height adjustment mechanism further includes a ramp member, wherein the ramp is formed on the ramp member, wherein the ramp member includes a first detent and a second detent, wherein the base includes a projection received in the first detent when the inlet is in the lower position and the projection is received in the second detent when the inlet is in the upper position.

25. The vacuum cleaner of claim 19, wherein the ramp has a constant incline.

26. The vacuum cleaner of claim 19, wherein the lift assembly is pivotally coupled to the housing such that the lift assembly can pivot with respect to the housing to move the inlet between the upper and the lower positions.

27. The vacuum cleaner of claim 26, further comprising a first wheel coupled to the housing, and wherein the guide member includes a second wheel, wherein the lift assembly pivots with respect to the housing to move the second wheel with respect to the first wheel to move the inlet between the upper and the lower positions.

28. The vacuum cleaner of claim 26, wherein the lift assembly includes a cam surface, wherein the cam surface rides along the ramp to move the inlet between the upper and the lower positions.

29. The vacuum cleaner of claim 19, wherein the height adjustment mechanism further includes a ramp member, wherein the ramp is formed on the ramp member, the ramp member includes a first stop and a second stop, the first stop limiting rotation of the ramp and the knob with respect the housing in a first direction, the second stop limiting rotation of the ramp and the knob with respect to the housing in a second direction opposite the first direction.

* * * * *